United States Patent [19]

Friesen et al.

[11] Patent Number: 4,704,915

[45] Date of Patent: Nov. 10, 1987

[54] VALVE CONTROL LOCKOUT

[75] Inventors: Henry Friesen, Niagara Falls; Antonius H. G. van Hooydonk, St. Catharines, both of Canada

[73] Assignee: Deere & Company, Moline, Ill.

[21] Appl. No.: 834,007

[22] Filed: Feb. 25, 1986

[51] Int. Cl.[4] ..... G05G 9/16

[52] U.S. Cl. ..... 74/471 XY; 74/526; 180/333

[58] Field of Search ..... 74/471 XY, 526; 180/272, 333; 16/2, 108, 109; 403/243, 194, 195, 197

[56] References Cited

U.S. PATENT DOCUMENTS

| | | | |
|---|---|---|---|
| 2,525,865 | 10/1950 | Chisolm et al. | 74/526 |
| 2,729,986 | 1/1956 | Fröbel | 74/526 |
| 3,365,975 | 1/1968 | Hathaway | 74/471 XY |
| 3,556,549 | 1/1971 | Hershman | 403/102 X |
| 3,818,154 | 6/1974 | Presentey | 74/471 XY |
| 4,432,431 | 2/1984 | Russell | 74/710.5 X |

OTHER PUBLICATIONS

John Deere 245 Loader Operator's Manual, om-W28503, Issue Al, p. 87 (Jan. 1981).

Letter & attached picture of Kubota Lockout for Loaded Boom Circuit Only-shown at the Farm Progress Show-Marion, Iowa on Sep. 28 & 29, 1983.

*Primary Examiner*—Cornelius J. Husar
*Assistant Examiner*—Joseph A. Fischetti
*Attorney, Agent, or Firm*—Henderson & Sturm

[57] ABSTRACT

A single-lever control lockout for a boom and bucket control lever. The lever is selectively movable in both fore-and-aft and side-to-side directions to control the lowering and raising of the boom and the roll back and dumping of the bucket. A cover encloses the control valve and the control lever extends through an opening in the cover. A lockout is slidably attached to the lever and is movable within the cover opening between a locked position where the lockout engages the cover, and a free position where the lockout is spaced from the cover thus allowing free movement of the lever in all directions.

9 Claims, 7 Drawing Figures

VALVE CONTROL LOCKOUT

TECHNICAL FIELD

This invention relates to bucket loaders, and more particularly to lockouts to selectively prevent the movement of the control lever for the boom and bucket function.

BACKGROUND ART

Front end loaders are available that utilize a single-lever control of both the boom and bucket. In certain situations, such as during transport, it is desirable and even sometimes required that the boom and bucket control lever be locked so that the boom and bucket circuits cannot be activated. Although various lockout devices have been used in combination with a control lever, such devices are complex in structure and operation, easily removed by the equipment operator, or limited to lock the control lever for only one of the boom or bucket functions.

Those concerned with these and other problems recognize the need for an improved single-lever control lockout.

DISCLOSURE OF THE INVENTION

The present invention provides a single-lever control lockout for a boom and bucket control lever. The lever is selectively movable in both fore-and-aft and side-to-side directions to control the lowering and raising of the boom and the roll back and dumping of the bucket. A cover encloses the control valve and the control lever extends through an opening in the cover. A lockout is slidably attached to the lever and is movable within the cover opening between a locked position where the lockout engages the cover, and a free position where the lockout is spaced from the cover thus allowing free movement of the lever in all directions.

The preferred embodiment of the invention includes an integrally formed molded lockout that has a locking flange having a peripheral edge that matingly engages the cover opening and an enlarged shoulder member that extends beyond the peripheral edge to engage one side of the cover adjacent the opening. Means for retaining the locking flange in the locked position includes a pair of oppositely directed retractable tabs that extend beyond the peripheral edge of the locking flange to selectively engage an opposite side of the cover adjacent the opening.

An object of the present invention is the provision of an improved single-lever control lockout.

Another object is to provide a single-lever control lockout that is inexpensive to manufacture.

A further object of the invention is the provision of a single-lever control lockout that simultaneously locks the control lever for both the boom and bucket functions of a front end loader.

Still another object is to provide a single-lever control lockout that is simple in structure and convenient to operate.

A still further object of the present invention is the provision of a single-lever control lockout that is not easily removed from the control lever.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
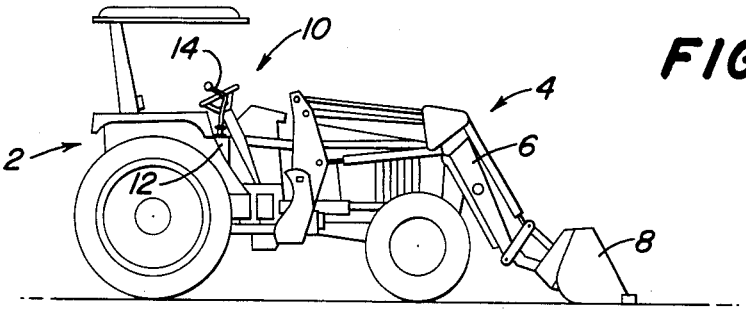
FIG. 1 is a side elevational view of a tractor/loader utilizing the single-lever control lockout of the present invention.

Referring now to the drawings, wherein like reference numerals designate identical or corresponding parts throughout the several views, FIG. 1 shows a tractor (2) having a front end loader (4) mounted thereon. The loader (4) includes a boom (6) movable between lowered and raised positions, and a bucket (8) movable between rolled back and dumped positions. The movements of the boom (6) and bucket (8) are controlled by a single-lever control (10). The control (10) includes a multi-position hydraulic selector valve (not shown) enclosed in a cover or housing (12) and operated by a control lever (14). The lever (14) extends upwardly through an opening (16) formed in the cover (12) and is selectively movable in both fore-and-aft and side-to-side directions.

Figure 2:
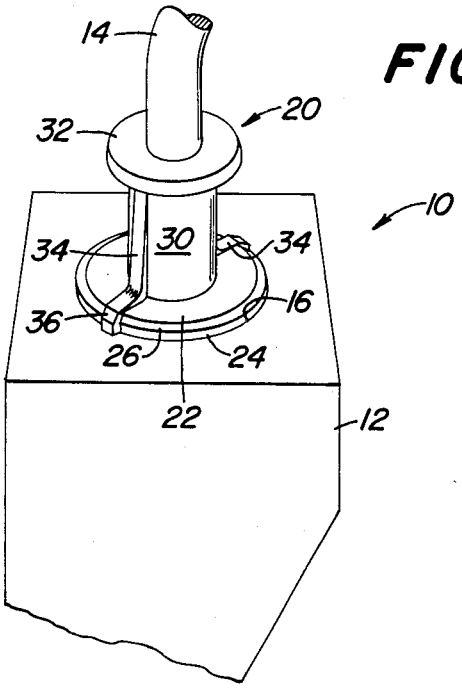
FIG. 2 is a greatly enlarged cut-away perspective view showing the lockout in the locked position wherein the lockout is engaging the control cover such that the lever is prevented from moving.
Figure 3:
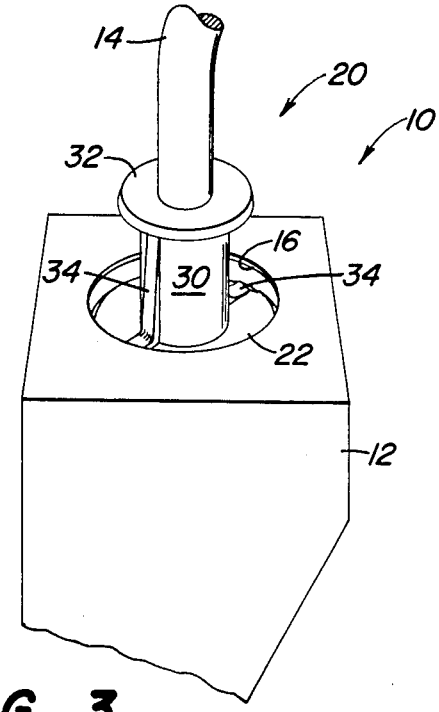
FIG. 3 is a perspective view similar to FIG. 3, but illustrating the lockout in the free position spaced from the cover to allow free movement of the lever in all directions.
Figure 4:
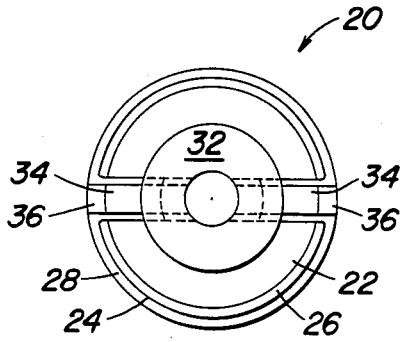
FIG. 4 is a top plan view of the integrally molded lockout.
Figure 5:
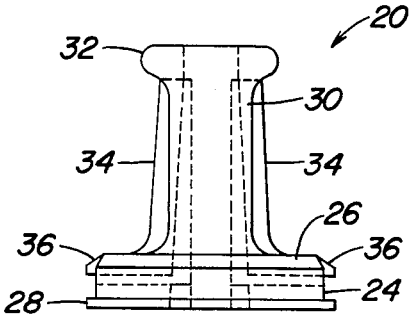
FIG. 5 is a side elevational view thereof showing the resilient tabs extending out from the peripheral edge of the locking flange spaced above the enlarged shoulder member.
Figure 6:
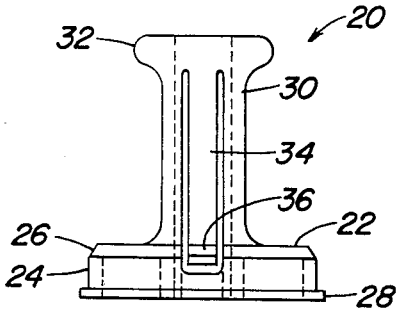
FIG. 6 is a side elevational view of the lockout wherein the lockout is rotated 90° from the FIG. 5 position.
Figure 7:
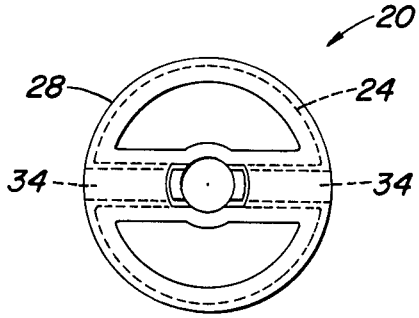
FIG. 7 is a bottom plan view of the lockout.

As best shown in FIGS. 2 and 3, an integrally formed plastic lockout (20) is slidably received on lever (14) and is movable between the raised locked position (FIG. 2) where the lockout (20) engages the cover (12) and prevents movement of the lever (14), and the lowered free position (FIG. 3) where the lockout (20) is spaced from the cover (12) and rests on the enclosed multi-position hydraulic selector valve (not shown) to allow free movement of the lever (14) in all directions.

Referring now to FIGS. 4–7, the lockout (20) includes an enlarged locking flange (22) having a peripheral edge (24) that is configured to matingly engage the opening (16) in the cover (12). The locking flange (22) also includes a beveled guide surface (26) that extends inwardly from the edge (24) and acts to guide the locking flange (22) into alignment with the opening (16) in the cover (12) as the lockout (20) is raised to the locked position. An enlarged shoulder member (28) extends outwardly from the bottom of the edge (24). The shoulder (28) engages the bottom side of the cover (12) adjacent the opening (16) when the lockout (20) is in the locked position. A neck section (30) extends upwardly from the locking flange (22) and terminates in a radially extending grip (32). A pair of outwardly biased resilient tabs (34) extend axially downward along the neck (30) and then outwardly beyond the peripheral edge (24) of the locking flange (22). The free ends of the tabs (34) have a beveled guide surface (36) which aid in alignment of the lockout (20) in the locked position. The tabs (34) are spaced upwardly from the shoulder member (28) (see FIG. 5) and the free ends engage the top side of the cover(12) adjacent the opening (16) when the lockout (20) is in the locked position.

In operation, the lockout (20) is positioned to slide over the lever (14) and the cover (12) is secured in position. To lock the lever (14), the operator simply pulls up on the grip (32) to raise the lockout (20) to the locked position (FIG. 2). As the lockout (20) is raised, the resilient tabs (34) first retract to clear the opening (16) and then spring out to engage the top side of the cover (12) adjacent the opening (16) as the shoulder (28) simultaneously engages the bottom side of the cover (12). The lever (14) is thus locked against movement in all directions by mating engagement of the edge (24) with the opening (16). The tabs (34) hold the lockout (20) in the raised locked position.

To disengage the lockout (20), the tabs (34) are simply pressed in and the lockout (20) is pushed down to the free position (FIG. 3) where the lever (14) is allowed to be moved freely in all directions. In this manner, the lockout (20) is easily and quickly engaged and disengaged by the operator as the situation requires.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

We claim:

1. In a bucket loader having a single-lever boom and bucket control including a cover enclosing said control and having an opening formed therein, and a control lever selectively movable in both fore-and-aft and side-to-side directions, said lever being operably connected to said control and extending upwardly therefrom and disposed to extend through said opening, the improvement comprising:

a lockout slidably attached to said lever above said control and movable within said opening between a locked position wherein said lockout engages said cover, and a free position wherein said lockout is spaced from said cover, thereby allowing free movement of the lever in all directions, said lockout including a locking flange having a peripheral edge conformed to matingly engage said opening and an enlarged shoulder member disposed to extend beyond said peripheral edge and disposed to engage one side of said cover adjacent said opening; and means for retaining said lockout in said locked position.

2. The single-lever control lockout of claim 1 wherein said retaining means includes a resilient tab attached to said locking flange, said tab including a free end disposed to move between a retracted position wherein said free end is disposed inwardly from said peripheral edge, and an extended position wherein said free end is disposed outwardly from said peripheral edge and spaced from said shoulder member, said free end being disposed to engage an opposite side of said cover adjacent said opening.

3. The single-lever control lockout of claim 2 wherein said retaining means includes a pair of said resilient tabs.

4. The single-lever control lockout of claim 3 wherein said pair of tabs are oppositely directed such that said free ends extend outwardly from said peripheral edge in opposite directions when said tabs are in said extended position.

5. The single-lever control lockout of claim 1 wherein said locking flange includes a beveled guide surface extending inwardly from said peripheral edge opposite said enlarged shoulder member.

6. The single-lever control lockout of claim 4 wherein said tabs include a beveled guide surface on said free ends.

7. The single-lever control lockout of claim 3 wherein said tabs are outwardly biased.

8. The single-lever control lockout of claim 4 wherein said lockout further includes:

a neck section extending axially away from said locking flange; and an enlarged grip extending radially outward from said neck section.

9. The single-lever control lockout of claim 8 wherein said resilient tabs are attached to said neck section.

* * * * *